United States Patent [19]

Malpas et al.

[11] Patent Number: 4,602,725

[45] Date of Patent: Jul. 29, 1986

[54] DISPENSING TAPS

[75] Inventors: Jon H. Malpas, Ocean Grove; Alan R. Calder, Melbourne, both of Australia

[73] Assignee: Diemoulders Pty. Ltd., Leopold, Australia

[21] Appl. No.: 485,702

[22] Filed: Apr. 18, 1983

[30] Foreign Application Priority Data

| | | | |
|---|---|---|---|
| Apr. 30, 1982 | [AU] | Australia | PF3796 |
| May 5, 1982 | [AU] | Australia | PF3867 |
| Jun. 23, 1982 | [AU] | Australia | PF4561 |
| Feb. 21, 1983 | [AU] | Australia | PF8126 |

[51] Int. Cl.[4] ..... B67B 7/24

[52] U.S. Cl. ..... 222/83.5; 222/541

[58] Field of Search ..... 222/83, 541, 80, 107, 222/105, 81, 83.5

[56] References Cited

U.S. PATENT DOCUMENTS

| | | | |
|---|---|---|---|
| 1,996,493 | 4/1935 | Schumacher | 222/541 |
| 2,028,175 | 1/1936 | Waite | 222/541 |
| 3,029,987 | 4/1962 | Gronemeyer | 222/541 |
| 3,207,375 | 9/1965 | Bereziat et al. | 222/541 |
| 3,474,933 | 10/1969 | Malpas | 222/541 |
| 3,968,872 | 7/1976 | Cavazza | 222/83 |
| 3,995,773 | 12/1976 | Schmit | 222/91 |
| 4,059,201 | 11/1977 | Foster | 222/541 |
| 4,322,018 | 3/1982 | Rutter | 222/107 |
| 4,355,737 | 10/1982 | Pongrass et al. | 222/81 |
| 4,450,985 | 5/1984 | Beard | 222/83.5 |
| 4,469,249 | 9/1984 | Malpas et al. | 222/553 |

FOREIGN PATENT DOCUMENTS

| | | |
|---|---|---|
| 2043037 | 10/1980 | United Kingdom . |
| 2082152 | 3/1982 | United Kingdom . |

*Primary Examiner*—Joseph J. Rolla
*Assistant Examiner*—Louise S. Heim
*Attorney, Agent, or Firm*—Tilton, Fallon, Lungmus & Chestnut

[57] ABSTRACT

A tap for a "bag-in-the-box" containers which includes a body having a cylindrical wall extending interiorily and exteriorily of the container, the cylindrical wall having a beveled end across which a diaphragm is mounted, a spigot having a cylindrical wall part rotatably mounted within the body cylindrical wall portion and also having a beveled end whereby rotation of the spigot within the body removes the diaphragm and brings openings in the body and spigot into alignment for beverage discharge.

10 Claims, 30 Drawing Figures

DISPENSING TAPS

This invention relates to improvements in or relating to taps and refers particularly, though not exclusively, to improvements in or relating to taps for use with the well-known "bag-in-the-box" containers for beverages.

The containers above referred to have been on the market in Australia for some considerable period of time. Since their introduction there has developed an expertise relating to their manufacture and their requirements. However, the major requirement for these containers is shelf life. The material of which the bag is constructed in normal circumstances (sheet plastics) allows a small amount of oxygen to permeate therethrough and this has an adverse effect upon the contents over a period of time. When the contents are fruit juice or wine the oxygen causes deterioration such as to significantly reduce the shelf life of the container. This has been overcome insofar as the bag is concerned by the use of a laminate material but it does not overcome the problem where the tap is concerned. As most taps are made of plastics material the oxygen can permeate the tap and cause a similar deterioration.

We have previously proposed various constructions of taps whereby there is placed at the innermost end of the tap a frangible diaphragm or seal of laminate construction which is oxygen impervious. These taps, whilst working effectively, have had the problem of complex construction and/or problems in their operation. Taps of this nature have been found in a certain sector of the community to require a manual operation whereas others require an automatic operation.

It is therefore the principal object of the present invention to provide a tap of relatively simple construction which provides for a frangible or removable oxygen impervious barrier and yet can be of automatic operation.

The present invention has as another object the provision of a tap which is of relatively simple production, is relatively easily manufactured and assembled, and provides for sufficient oxygen barrier.

With the above and other objects in mind the present invention provides a tap having a body and a spigot, said body being adapted to receive said spigot, said body having an inner end closed by a sealing means, said spigot having an inner end adapted to pierce or remove in total or in part said sealing means upon relative movement of said spigot and said body.

The invention also provides a tap including a body having an internal opening, a lever adapted to close said opening, a removable or frangible seal across said lever to seal said opening, an outlet from said tap, said lever having means attached thereto by which said opening can be closed when said lever is in a first position and opened when said lever is in a second position; movement of said lever from said first to said second position causing removal of said removable or frangible diaphragm.

In order that the invention may be better understood there shall now be described preferred constructions of taps incorporating the principal features of the present invention. The description will be by way of non-limitative example only and with reference to the accompanying drawings. In the drawings.

Figure 1:
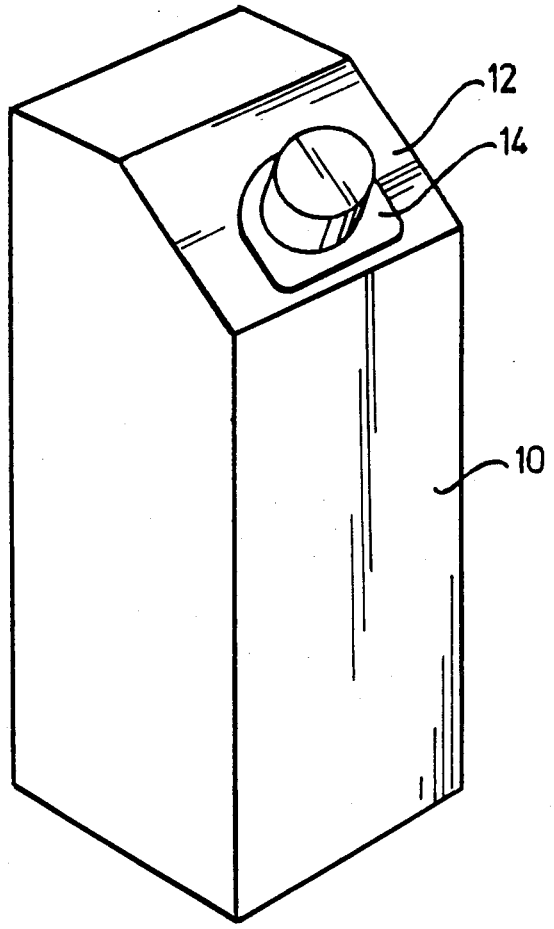
FIG. 1 is a perspective view of a container having fitted thereto a tap incorporating the features of the present invention.

To firstly refer to FIGS. 1 to 5 there is shown a container 10 which is an outer container of suitable material such as plastics or cardboard and which is used to hold a fluid which, preferably, is contained within a separate, flexible and collapsible bag within the container 10.

Fitted to the container 10 is a tap 12 which has a flange 14 to retain the tap 12 in position in relation to the container 10.

The tap 12 is clearly seen in FIGS. 2 to 5 inclusive and comprises a body 16 the outer end of which comprises the flange 14. Extending axially outwardly from the flange 14 is a spigot receiving part 18 which is open at each end. The inner end 20 of the spigot receiving part 18 is angled as is shown in the drawings. The inner end 20 is closed by a rupturable or peelable diaphragm or seal 22 which is secured to the inner end 20 by means of gluing, welding, or heat application. The spigot receiving part 18 also has an outlet 24 so that contents can be dispensed as will be understood hereafter.

The entire body 16 is adapted to be received within a plug 26 which is located inside the container 10 and which is attached thereto by means of a groove 28. The inner end of the plug 26 is secured to a bag 30 located within the container 10 and in which bag 30 the contents are held. The bag 30 is collapsible so that the contents of the bag 30 are not subjected to contact with oxygen or air during normal usage.

Located within the spigot receiving part 18 is a spigot 32. At the outer end of the spigot 32 there are provided seals 34 locating in corresponding grooves in the spigot receiving part 18 so that the spigot once inserted cannot be unwantedly removed and to provide for a fluid-seal between the spigot 32 and the spigot receiving part 18. The spigot 32 has an inner end 36 which corresponds in shape and angle to the inner end 20 of spigot receiving part 18. The inner end 36 is adapted, in use, to tear, puncture or lift the seal 22 off the inner end 20 when the spigot is rotated about its longitudinal axis as will be understood by the following description.

The spigot has an opening 38 which is designed to co-operate with the outlet 24 when the spigot is in the ON position (see FIG. 5) to allow the contents of the bag 30 to be dispensed.

Integral with the spigot 32 is a handle 40 which closes the outer end of the spigot and also provides a means by which a user can operate the tap. The handle 40 has an opening 42 therein to enable the contents of the bag 30 to be properly dispensed when the opening 42 is in radial alignment with the opening 38 in the spigot 32. The handle 40 extends axially inwardly in parallel with the spigot so as to surround the spigot receiving part 18. To provide for a proper and double sealing effect when the tap is in the OFF position the handle skirt 44 has a radially inwardly directed projection 46 which, when the tap is in the OFF position, closes the outlet 24. The projection not only provides for a proper closing of the outlet 24 but would also tend to prevent any quantity of fluid in the outlet 24 from forming a drip which would tend to come from the handle at a later date.

Figure 2:
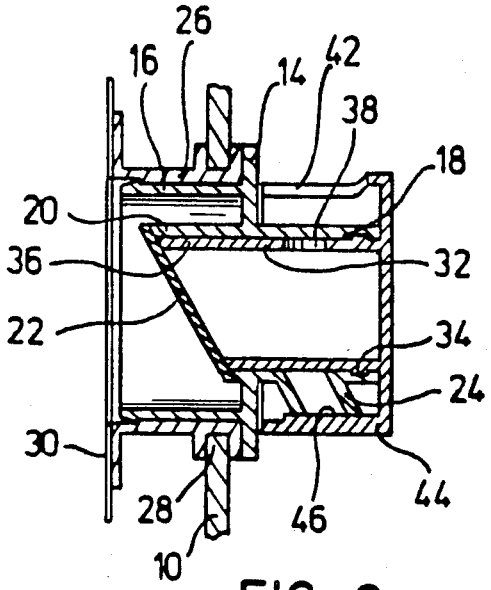
FIG. 2 is a vertical cross-section through the longitudinal axis of the tap of FIG. 1 prior to operation of the tap.
Figure 3:
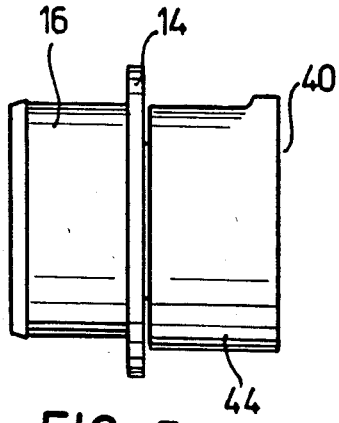
FIG. 3 is a side view of the tap of FIG. 2.
Figure 4:
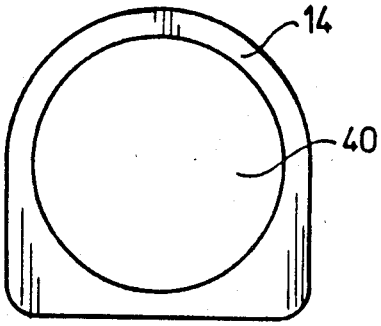
FIG. 4 is an end view of the tap of FIG. 2.
Figure 5:
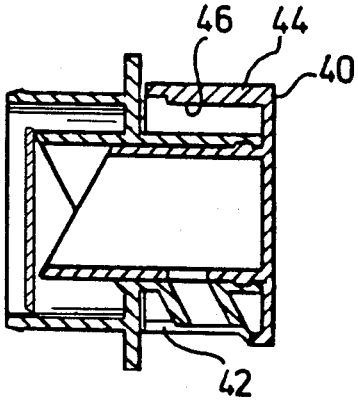
FIG. 5 is a vertical cross-section through the longitudinal axis of the tap of FIG. 2 after operation of the tap.
Figure 6:
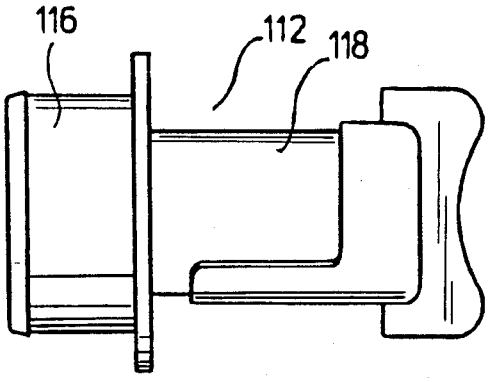
FIG. 6 is a side view of a second embodiment of a tap incorporating the principal features of the present invention.
Figure 7:
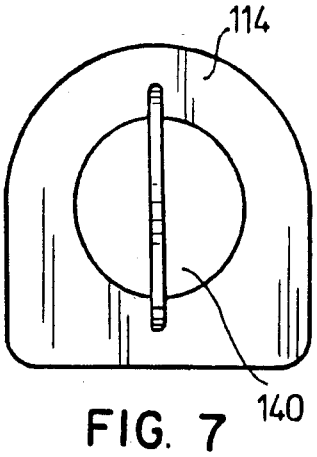
FIG. 7 is an end view of the tap of FIG. 6.
Figure 8:
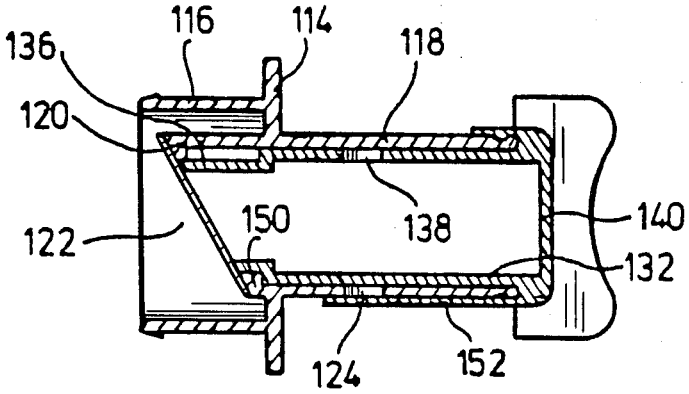
FIG. 8 is a vertical cross-section through the longitudinal axis of the tap of FIG. 6 prior to the operation of that tap.
Figure 9:
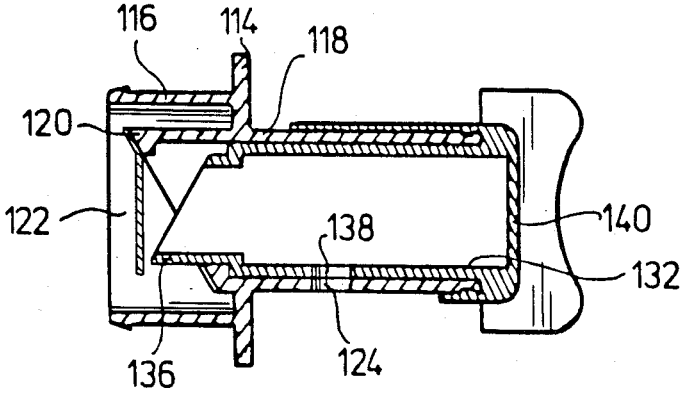
FIG. 9 is a vertical cross-section through the longitudinal axis of the tap of FIG. 6 after the operation of that tap.
Figure 10:
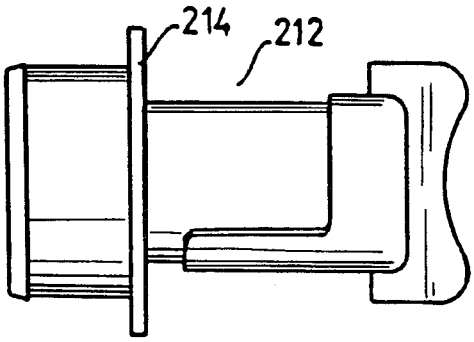
FIG. 10 is a side elevation of a third embodiment of a tap incorporating the principal features of the present invention.
Figure 11:
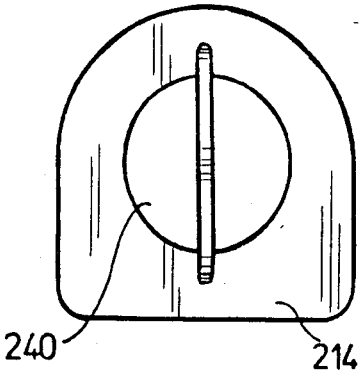
FIG. 11 is an end view of the tap of FIG. 10.
Figure 12:
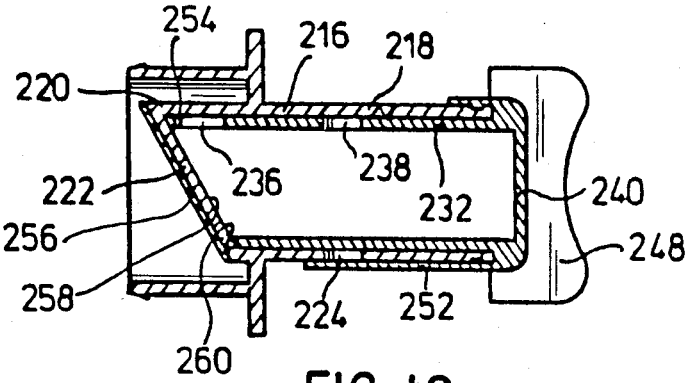
FIG. 12 is a vertical cross-section through the longitudinal axis of the tap of FIG. 10 prior to the operation of that tap.
Figure 13:
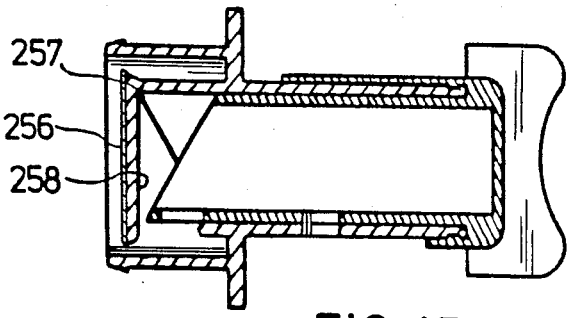
FIG. 13 is a vertical cross-section through the tap of FIG. 10 after the operation of that tap.

The operation of the tap 12 is such that it is in the OFF position as shown in FIG. 2. Upon the handle 40 being rotated the inner end 36 of the spigot 32 moves so as to force the seal 22 away from the inner end 20 of spigot receiving part 18. This can be done in the manner illustrated by breaking the glue, weld or the heat-securing or, alternatively, by actually tearing or rupturing the seal 22. When the handle 40 has been rotated through 180 degrees the removal of the seal 22 to allow fluid to flow is complete. When this happens the opening 38 in the spigot 32 is in alignment with the outlet 34 so that the fluid can travel through the hollow interior of the spigot 32, through the opening 38, and out via the outlet 24. To enable it to be passed through to a consumer it then passes through the opening 42 in the skirt 44 of the handle 40. Upon the tap being turned to the OFF position the projection 46 covers the outlet 24 and the opening 38 moves out of alignment with the outlet 24. This effectively seals the tap against any fluid outflow.

If desired, there may be placed a further opening in the spigot 32 adjacent the inner end 36 to allow for proper fluid flow should the seal 22 accidentally clog the inner end 36 of the spigot 32.

If desired, the projection 46 can extend around a substantial portion of the inner surface of the skirt 44 so that it completely blocks the outlet 24 except when the tap is in the ON position when the opening 42 is adjacent the outlet 24.

For the embodiment of FIGS. 6 to 9 similar reference numerals have been used for similar parts except with the addition of a prefix number 1.

Here, the tap 112 operates in exactly the same way as the tap 12 of FIGS. 1 to 5 and has a flange 114, a body 116, a spigot receiving part 118, an inner end of the spigot receiving part 120, a seal 122 across the inner end 120 at the same or a similar angle, but has an outlet 124 in the form of a hole in the spigot receiving part 118.

Mounted within the spigot receiving part 118 is a spigot 132 having an angled inner end 136 on a similar angle to the inner end 120 of the spigot receiving part 118. The spigot 132 has an opening 138 which is adapted to align with the outlet 124 when the tap is in the ON position. The outer end of the spigot 132 is closed by a handle 140 which is provided with a finger grip 148.

The inner end 136 of the spigot 132 is of smaller radial extent due to the spigot receiving part 118 having a flange 150. The flange 150 is provided to allow greater area for easier attachment of the seal 122 to the inner end 120 of the spigot receiving part 118. The operation of the spigot 132, its inner end 136 and the seal 122 is exactly as was described for FIGS. 1 to 5.

A further difference is that the spigot 132 has a portion 152 which is used to also close the outlet 124 when in the OFF position. The portion 152 wipes over the hole of outlet 124 to prevent any possible drips passing through and out of the tap. It also provides for further oxygen protection.

It is believed the operation of the embodiment of FIGS. 6 to 9 is quite clear from the drawings and from the description of the embodiment of FIGS. 1 to 5.

For the embodiment of FIGS. 10 to 13 again like reference numerals are used for like components except that the prefix numeral 2 is added.

Here, there is a tap 212 which has a flange 214, a body 216, a spigot receiving part 218, an inner end 220 of the spigot receiving part, a seal 222 across the inner end 220, an outlet 224, a spigot 232, the inner end 236 of the spigot being arranged as per previous embodiments, an opening 238, a handle 240 having a grip 248, and a wipe clean portion 252. The main difference of this embodiment over the previous embodiments is that the inner end 236 of the spigot 232 has an opening 254 as was described as an alternative or additional feature for the embodiments of FIGS. 1 to 5. Furthermore, the seal 222 comprises a diaphragm 256 which is similar to the seal 222 of the previous two embodiments. The diaphragm 256 is mounted on a disc 258 which is integral with the spigot receiving part 218 and blocks the inner end 220 of that spigot receiving part 218. The disc is provided with a weakness portion 260 for much of its circumference with the only part of the disc 258 not having the weakness portion 260 being that at the top of the spigot receiving part 218. The disc 258 is provided so that upon the spigot being turned it will force the disc out by virtue of the weakness portion 260. However, the part of the disc 258 not having the weakness portion will remain attached to the inner end 220 of the spigot receiving part 218 in the form of a hinge 257. This will also push the diaphragm 256 away from the inner end 220 of the spigot receiving part 218. The strength of the material of the disc 258 will tend to hold it in that position so that it would not foul or block the opening to the hollow interior of the spigot 232. This would tend to increase the capacity of fluid flow into the spigot 232 and thus out through the opening 238 and the outlet 234. The weakness portion may be provided by having material of far less thickness, perforations, or as otherwise may be suitable.

Figure 14:
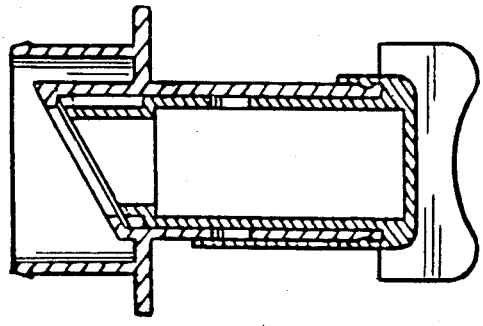
FIG. 14 is a vertical cross-section through the longitudinal axis of a fourth embodiment incorporating the principal features of the present invention prior to the operation of that tap.
Figure 15:
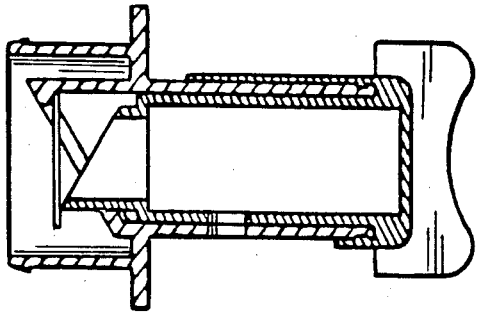
FIG. 15 is a view corresponding to that of FIG. 14 after the operation of the tap.

FIGS. 14 and 15 show a variation on the above where the seal has been located inside the flange at the inner end of the spigot receiving part. This allows for the outer edges of the seal to be not in contact with the contents of the container. When the seal is a laminate, it has been found that certain liquids (e.g. wine) contain certain acids that corrode the adhesive used to create the laminate and/or one of the layers of the laminate. By using this form, the contents are in contact with one surface only and not the edge of the seal.

Figure 16:
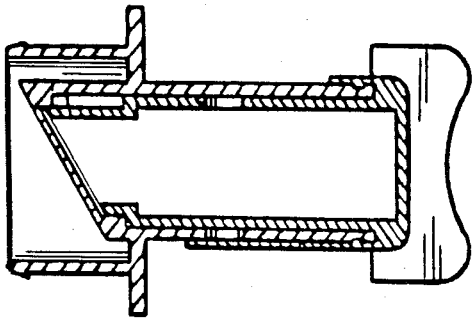
FIG. 16 is a view similar to that of FIG. 14 of a fifth embodiment.
Figure 17:
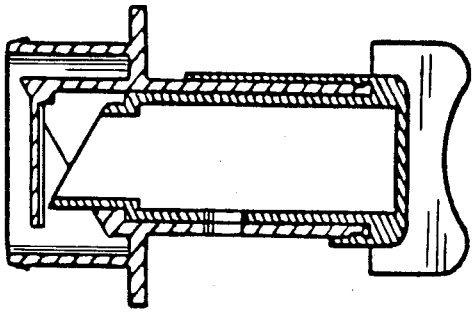
FIG. 17 is a view corresponding to that of FIG. 16 after the operation of the tap.

The variation of FIGS. 16 and 17 is exactly the same as that of FIGS. 14 and 15 except that a disc is added in exactly the same way as for the embodiment of FIGS. 10 to 13.

To refer now to FIGS. 18 to 21 there is shown a tap 310 which comprises a body 312, a handle 314, and an operating lever 316.

The body 312 is generally cylindrical and has an inner end 318 which has external ribs 320 designed to hold the tap 310 in a sleeve (not shown). The body 312 also has a radially extending flange 322 which is also designed to co-operate with the sleeve (not shown) to provide a limit for movement. Extending radially inwardly is an inner flange 324 which extends into the hollow interior of the body 312.

At the outer end 326 of the body 312 there are provided two radially extending ribs 328, 330 which are designed to co-operate with the handle 314 to retain the handle 314 in position. The first rib 328 also protects the handle 314 from being removed from the body 312 accidentally during use of the tap. The body is preferably made of a relatively rigid plastics material so as to provide for necessary strength.

The handle 314 locates around the outer end 326 of body 312 and locates between ribs 328, 330 and over rib 330 so as to prevent unwanted removal of the handle 314 from the body 312. The handle, like the body, is a one-piece plastics moulding although the handle is made of a relatively flexible material. The external skirt 332 locates as is explained above over the outer end 326 of the body and covers the end of body 312 by means of the flexible diaphragm portion 334. The diaphragm portion is off-set in its lower areas to provide a finger receiving portion 336. Axially located in the handle is a tapered socket 338 which is adapted to receive the longitudinally extending member of the lever. The handle in its upper portion has a flexible bulb-like "spring" 340 which is relatively resilient. Upon operation of the handle the spring is compressed and provides the necessary resilience to force the handle to return to the position shown in FIG. 20.

Attached to the handle 314 is a closure member 342. This closure member is in the form of a cylinder and is integral with the socket 338 at its upper portion. The closure member 342 is designed to contact the bore wall of the body 312 to close an outlet 344.

As is explained above the socket 338 receives the longitudinally extending member 346 of the lever 316. The member 346 is retained within the socket in the manner of a tightly sealed fit. The lever 316 also includes a closing member 348 which is perpendicular to and integral with the longitudinal member 346. In its manufactured form, the closing member 348 is integral with the inner flange 324 although there are provided a number of perforations 350 so that the closing member 348 may be separated from the inner flange 324. At its lower point, the closing member is hinged to the inner flange 324 by means of a hinge 352.

Located on the innermost surface of the closing member 348 of lever 316 is a removable or frangible seal 354. This seal is oxygen impervious and is attached to the inner surface of closing member 348 and inner flange 324 by means of glue, welding, heat-sealing, or any other suitable attachment. The seal 354 provides for an oxygen barrier to prevent the ingress of oxygen into the containers of the bag (not shown).

Figure 20:
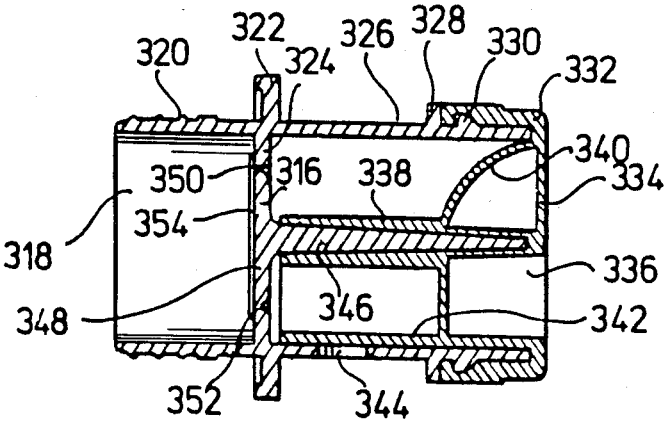
FIG. 20 is a vertical cross-section through the tap of FIG. 18.
Figure 21:
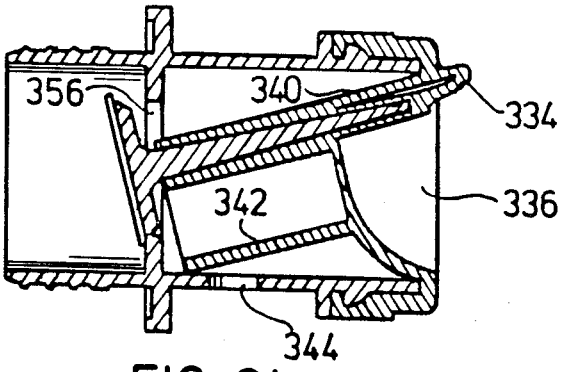
FIG. 21 is a vertical cross-section of the tap of FIG. 18 in the second position.
Figure 22:
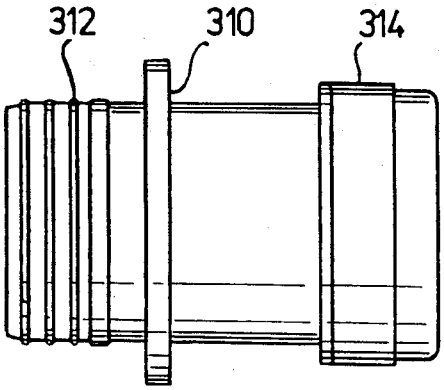
FIG. 22 is a side view of a seventh embodiment of the tap incorporating the features of the present invention.

The operation of the device is best understood by comparing FIG. 20—the closed position—to FIG. 21—the open position. Here it can be seen that upon a finger or other suitable device being placed in the finger receiving portion 336 and an upwardly directing force being made the handle will effectively pivot around the hinge 352. This is due to the operation of the handle socket 338 upon the longitudinal member 346 of the lever 316. The spring 340 is compressed or extended into the shape shown in FIG. 21 so as to provide for the suitable return force. Upon the movement upwards, the perforations 350 around the closing member 348 are broken—but not the hinge 352. This lever action provides for significant force advantage as the length of the longitudinal member 346 as against the radius of the closing member 348 gives the mechanical advantage involved. This enables the seal 354 to be "peeled" or fractured from the inner flange 324, as is shown in FIG. 21. This then creates an opening 356 through which the contents of the bag (not shown) can be dispensed. As the closure member 342 is integral with the socket 338 it is also lifted to the position shown in FIG. 21 and thus the contents of the bag (not shown) can pass through the opening 356, around the socket 338 and the entrapped longitudinal member 346, past the closure member 342 and out through the outlet 344. Upon the force to the outer end of socket 338 being removed, the stretch effect upon the lower portion of the handle and the spring 340 will force the handle back to the closed position as shown in FIG. 20.

FIGS. 22 to 25 show a variation which operates in exactly the same way as in the FIGS. 18 to 21 except that the closure member 342 is not in the form of a longitudinally extending cylinder but in the form of a vertically extending cylinder 343. In this particular case the closure member can have an extended portion 345 in its lower end 347 which would pass into the outlet 344 so as to prevent the retention of any fluid therein which may cause a drip at a later stage. This is the only difference between the two.

Figure 26:
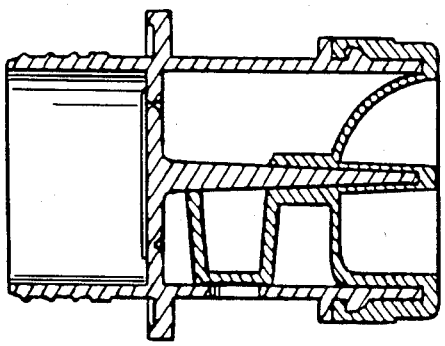
FIG. 26 is a vertical cross-section through the tap of FIG. 22 showing a modification.
Figure 27:
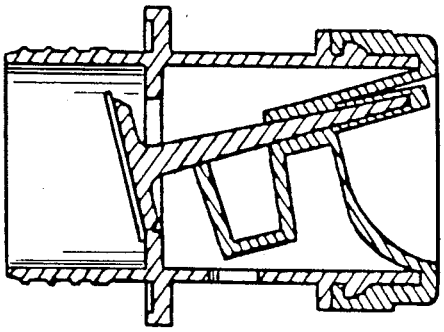
FIG. 27 is a view corresponding to that of FIG. 26 with the tap in the second position.

Similarly, FIGS. 26 and 27 show a variation of the embodiment of FIGS. 22 to 25 wherein the extension on the lower portion of the closure member 342 is removed.

Figure 23:
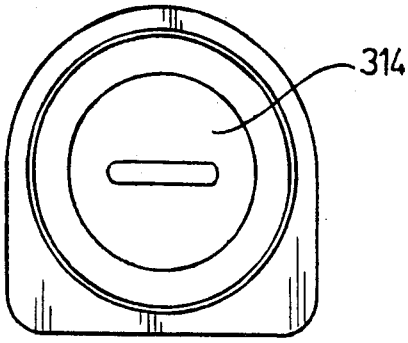
FIG. 23 is an end view of the tap of FIG. 22.
Figure 24:
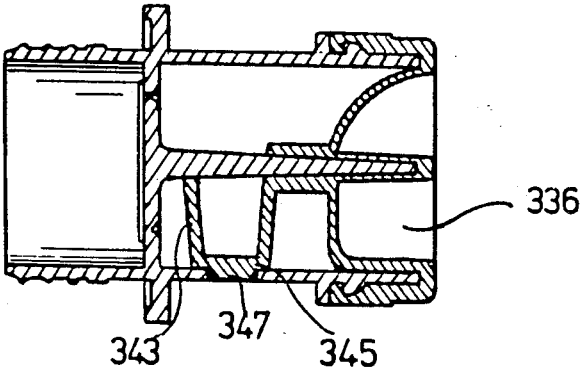
FIG. 24 is a vertical cross-section through the tap of FIG. 22.
Figure 25:
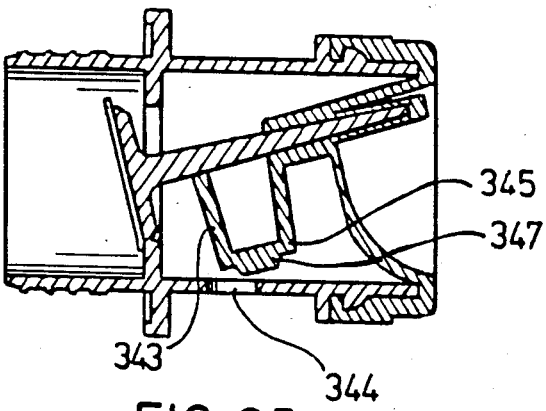
FIG. 25 is a vertical cross-section through the tap of FIG. 22 when in the second position.

As is shown particularly in FIGS. 23 and 24, the handle for the two variations may be made more simple such that the handle is in the form of a dish and has an outwardly extending tab into the dish to provide for the finger grip. However, if desired, the handle could be made in the same way as for FIGS. 18 to 21. Similarly, the handle of the embodiment of FIGS. 18 to 21 could be made in the way shown in FIGS. 23 and 24 rather than is shown in FIGS. 19 and 20.

Figure 18:
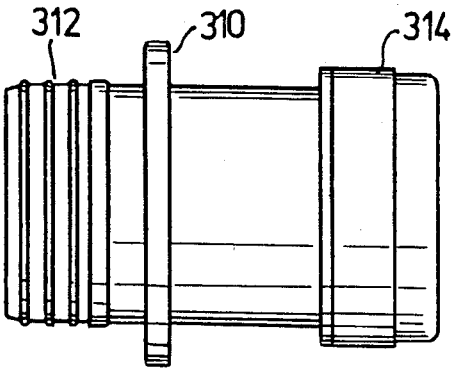
FIG. 18 is a side view of a sixth embodiment of a tap incorporating the features of the present invention.
Figure 19:
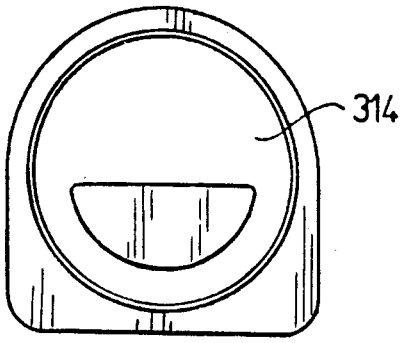
FIG. 19 is an end view of the tap of FIG. 18.

If desired, there may be provided a cap to be placed over the skirt of the handle and which, in the case of the handle of FIGS. 18 to 20, would have a projection extending into the finger receiving portion 336 and, in the case of FIGS. 22 to 26, would have a socket for receiving the outer end of the socket 338. This cap would be used while the tap was in transit to prevent accidental or unwanted operation.

Figure 28:
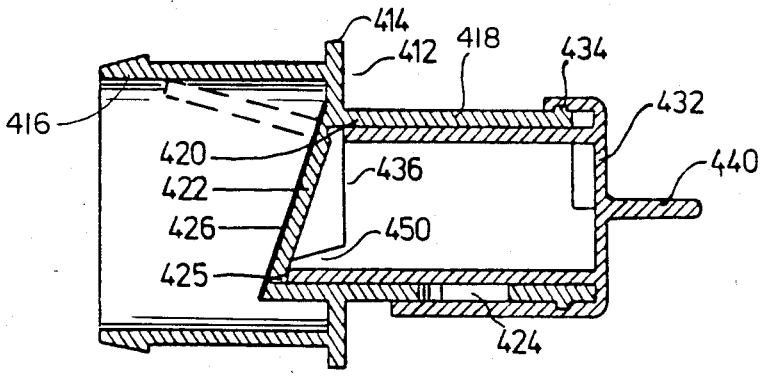
FIG. 28 is a vertical cross-section through the longitudinal axis of an eighth embodiment of a tap incorporating the features of the present invention.

Referring now to FIG. 28 there is shown a tap 412 having a body 416 with a flange 414 at one end. The tap is fitted to a container (not shown) by the flange for dispensing of liquid. Extending axially outwardly from the flange 414 is a spigot receiving part 418 which is open at one end. The inner end 420 of the spigot receiving part 418 is angled as is shown in the drawings. The inner end 420 is closed by a rupturable diaphragm 422 which is integrally moulded with the spigot receiving part 418. The diaphragm 422 has a weakness portion 425 for much of its circumference with the only part of the diaphragm not having the weakness portion being that at the top of the spigot receiving part 418. To protect the container contents from oxidation a seal 426 is secured to the inner end 420 by means of gluing, welding or heat welding.

Located within the spigot receiving part 418 is a spigot 432. At the outer end of the spigot 432 there are provided seals 434 locating in corresponding grooves in the spigot receiving part 418 so that the spigot once inserted cannot be unwantedly removed and to provide for a fluid-seal between the spigot 432 and the spigot receiving part 418. The spigot 432 has an inner end 436 which has a cam 450 thereon. The cam 450 is adapted, in use, to rupture and lift the diaphragm 422 off the inner end 420 when the spigot is rotated about its longitudinal axis as will be understood by the following description.

The spigot has an opening (not shown) which is designed to co-operate with the outlet 424 when the spigot is in the ON position to allow the contents of the container to be dispensed. Integral with the spigot 432 is a handle 440 which closes the outer end of the spigot and also provides a means by which a user can operate the tap.

The operation of the tap is such that it is in the OFF position as shown in the drawing. Upon the handle 440 being rotated the cam 450 will force the diaphragm 422 outwardly and rupture both diaphragm 422 and seal 426 along the weakened portion 425. Thus the diaphragm will be lifted and pivoted upwardly to the dotted line position 422' to provide an unobstructed passage of liquid through the tap.

Figure 29:
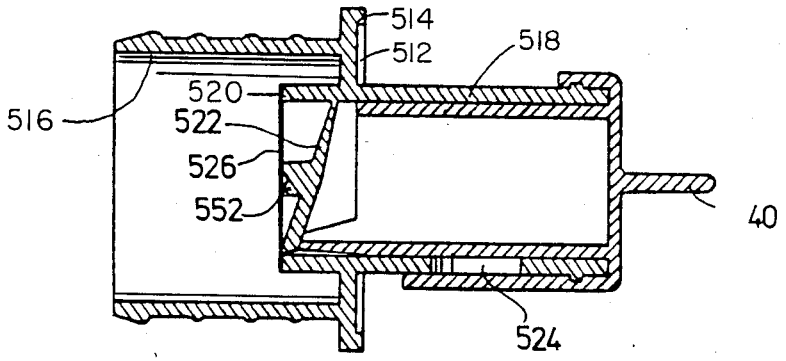
FIG. 29 is a similar view to that of FIG. 28 of a ninth embodiment of a tap incorporating the principal features of the present invention.

For the embodiment of FIG. 29 similar reference numerals have been used for similar parts as the embodiment of FIG. 28 except with the change of the prefix number from 4 to 5.

Here, the tap 512 operates in exactly the same way as the tap 412 of FIG. 28 and has a flange 514, a body 516, a spigot receiving part 518, an inner end of the spigot receiving part 520, and a diaphragm 522 across the inner end 520. In this embodiment the diaphragm 522 and seal 526 are in different planes. The inner end 520 is not at an angle and has a vertically mounted seal 526. The diaphragm 522 is at an angle and has a projection 552 for assisting in the rupturing of seal 526. The projection 552 is heat sealed to seal 526.

It is believed the operation of the embodiment of FIG. 29 is quite clear from the drawing and from the description of the embodiment of FIG. 28.

Figure 30:
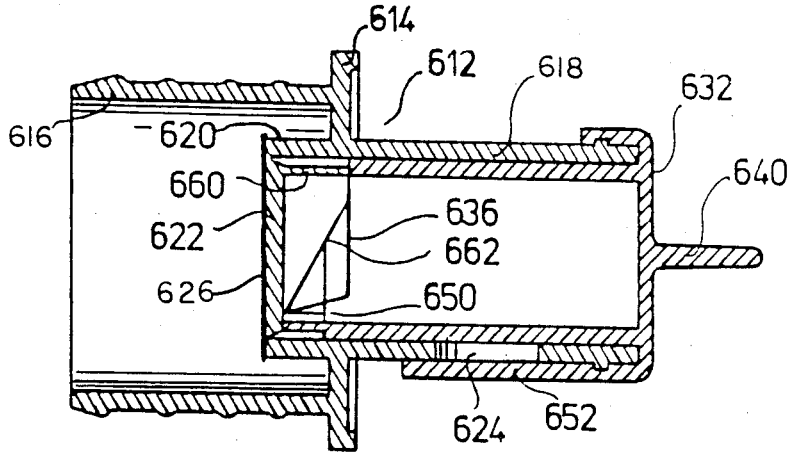
FIG. 30 is a similar view to that of FIG. 28 of a tenth embodiment of a tap incorporating the principal features of the present invention.

For the embodiment of FIG. 30 again like reference numerals to those of FIGS. 28 and 29 are used for like components except that the prefix number is changed to "6".

Here, there is a tap 612 which has a flange 614, a body 616, a spigot receiving part 618, an inner end 620 of the spigot receiving part, a diaphragm 622 across the inner end 620, an outlet 624, a spigot 632, the inner end 636 of the spigot being arranged as per the embodiments of FIGS. 28 and 29, a handle 640 and a wipe clean portion 652. This embodiment is a cross between the embodiments of FIGS. 28 and 29 and has the diaphragm 622 and seal 626 in the same plane as per FIG. 28, but has them vertically oriented as per the seal 526 of FIG. 29. The diaphragm 622 includes a skirt 660 with an angled cam face 662. The cam 650, instead of co-operating directly with the inner face of diaphragm as per the embodiments of FIGS. 28 and 29, engages the angled cam face 662 to cause rupturing of the diaphragm and seal.

The material of the tap itself may be any suitable material preferably being a plastics material suitable for injection moulding.

The seal may be made in any suitable way or form and is preferably made as a plastics disc, a laminated plastics or other material, or any suitable material or combination of materials. The functional requirement of the seal is that it must be impervious to the ingress of oxygen or air for a period of approximately 6 to 12 months. This is to allow for sufficient shelf life for the contents of the container.

As will be understood from the foregoing one aspect of the present invention is to use a liftable and/or sealable seal which is mounted within that of body to provide for a cam-lifting action by the spigot. If desired, the various seals may be secured to the inner end of the spigot receiving part by means of ring seals so that the spigot inner end would peel the seal from the inner end of the spigot receiving part for a suitable portion of its circumference to allow adequate liquid flow and non-restricted access by the fluid into the interior of the spigot.

If desired, the inner end of the spigot could be shaped non-uniformly to provide a multiplicity of cams on the seal to lift the seal in a number of stages. Alternatively or additionally the inner end of the spigot may be provided with a number of axially inwardly projecting teeth which would act to cut into and actually tear all or a portion of the seal so as to physically remove it.

Whilst there has been described in the foregoing description preferred constructions of taps incorporating the essential features of the present invention it will be appreciated by those skilled in the particular technical field that many variations or modifications in details of design or construction may be made without departing from the essential form of the invention which will be determined from the scope of the following claims.

We claim:

1. A tap adapted to be mounted on a beverage container to communicate the container interior to the outside for dispensing beverage, comprising:

a relatively elongate body adapted to be mounted on said container and including a longitudinally extending wall portion providing a hollow cylindrical bore having an inner end and an outer end, said wall portion at said inner end terminating in a plane disposed at an angle to the axis of said cylindrical bore, a discharge outlet in said wall portion adjacent said outer end, a diaphragm peelably secured to the inner end of said wall enclosing said bore against beverage flow therein, and a spigot having a cylindrical outer wall part rotatably mounted in said bore and extending beyond said outer end, said spigot wall part also having an inner end and an outer end with the inner end thereof being beveled to correspond to said plane and being positioned closely adjacent to said diaphragm, said spigot wall part having a discharge opening therein alignable with said body discharge outlet upon rotation of said spigot in removing said diaphragm, said spigot having handle means adjacent the outer end of said wall part.

2. The tap of claim 1 in which said spigot wall part has an additional discharge opening adjacent said inner end.

3. The tap of claim 1 in which said body wall portion of the inner end thereof is equipped with a radially inwardly extending flange to provide additional surface area for the mounting of said diaphragm.

4. The tap of claim 3 in which said flange has a cylindrical bore of reduced diameter relative to the diameter of said wall portion bore, said spigot wall part having a reduced diameter at the inner end thereof to fit within said flange bore.

5. The tap of claim 1 in which said spigot has a skirt positioned a spaced distance radially outwardly of said wall part and adapted to close said body discharge outlet when said spigot discharge opening is out of alignment with said body discharge outlet.

6. The tap of claim 1 in which said body wall at the inner end thereof is equipped with a disc integrally, circumferentially connected to said wall portion and closing said wall portion bore, said disc having an interrupted circumferential line of weakness adjacent the connection thereof to said wall portion whereby said disc is selectively detachable from said wall portion upon rotation of said spigot and with the interrupted part of said line of weakness serving as hinge means for said disc.

7. A tap adapted to be mounted on a beverage container to communicate the container interior to the outside for dispensing beverage, comprising:

a relatively elongate body adapted to be mounted on said container and including a longitudinally extending wall portion providing a hollow cylindrical bore having an inner end and an outer end, said wall portion at said inner end terminating in a plane disposed at an angle to the axis of said cylindrical bore, a discharge outlet in said wall portion adjacent said outer end, a diaphragm peelably secured to the inner end of said wall enclosing said bore against beverage flow therein, and a spigot having a cylindrical outer wall part rotatably mounted in said bore and extending beyond said outer end, said spigot wall part also having an inner end and an outer end with the inner end thereof being beveled to correspond to said plane and being positioned closely adjacent to said diaphragm, said spigot wall part having a discharge opening therein alignable with said body discharge outlet upon rotation of said spigot in lifting said diaphragm from said inner end of said wall portion enclosing said bore, said spigot having handle means adjacent the outer end of said wall part.

8. A tap adapted to be mounted on a beverage container to communicate the container interior to the outside for dispensing beverage, comprising:

a relatively elongate body adapted to be mounted on said container and including a longitudinally extending wall portion providing a hollow cylindrical bore having an inner end and an outer end, said wall portion at said inner end terminating in a plane disposed at an angle to the axis of said cylindrical bore, a discharge outlet in said wall portion adjacent said outer end, a diaphragm peelably secured to the inner end of said wall enclosing said bore against beverage flow therein, and a spigot having a cylindrical outer wall part rotatably mounted in said bore and extending beyond said outer end, said spigot wall part also having an inner end and an outer end with the inner end thereof having means positioned closely adjacent to said diaphragm, said spigot wall part having a discharge opening therein alignable with said body discharge outlet upon rotation of said spigot in lifting said diaphragm from said inner end of said wall enclosing said bore, said spigot having handle means adjacent the outer end of said wall part.

9. The tap of claim 8 wherein said sealing means further includes a disc across said inner end of said body, said disc being joined at the topmost portion of the circumference of said disc to said body to act, in use, as a hinge and said peelable diaphragm is attached to the outer surface of said disc and the inner end of said body.

10. A tap having a body and a spigot, said body being adapted to receive said spigot, said body having an inner end terminating in a plane disposed at an angle to the axis of the body and closed by a peelable sealing means, said spigot having an inner end being bevelled to correspond to said plane and being positioned closely adjacent to said sealing means, said spigot inner end adapted to peelably remove said sealing means upon relative movement of said spigot and body and without rupturing said sealing means.

* * * * *